US005142856A

United States Patent [19]

Nakayama et al.

[11] Patent Number: 5,142,856

[45] Date of Patent: Sep. 1, 1992

[54] YARN PIECING METHOD FOR YARN SPINNING MACHINE

[75] Inventors: Takashi Nakayama, Otsu; Takashi Iwade, Kyoto, both of Japan

[73] Assignee: Toray Engineering Co., Ltd., Osaka, Japan

[21] Appl. No.: 610,683

[22] Filed: Nov. 8, 1990

[51] Int. Cl.[5] ..... D01H 13/26; D01H 7/46; D01H 7/92

[52] U.S. Cl. ..... 57/22; 57/261; 57/264

[58] Field of Search ..... 57/22, 264, 261, 80, 57/81, 263

[56] References Cited

U.S. PATENT DOCUMENTS

| | | | |
|---|---|---|---|
| 1,425,084 | 8/1922 | Lander | 57/80 |
| 3,759,026 | 7/1973 | Hope | 57/80 |
| 4,319,235 | 3/1982 | Janousek | 57/264 X |
| 4,389,837 | 6/1983 | Stahlecker et al. | 57/264 X |
| 4,404,791 | 9/1983 | Wolf et al. | 57/264 X |
| 4,432,197 | 2/1984 | Ueda et al. | 57/264 X |
| 4,489,544 | 12/1984 | Morita et al. | 57/263 X |
| 4,650,822 | 4/1987 | Meissner et al. | 57/264 X |
| 4,716,718 | 1/1988 | Göbbels et al. | 57/264 X |
| 4,878,344 | 11/1989 | Igel | 57/261 |

FOREIGN PATENT DOCUMENTS

| | | | |
|---|---|---|---|
| 0016940 | 2/1980 | European Pat. Off. | 57/80 |
| 3524073 | 1/1987 | Fed. Rep. of Germany | 57/80 |
| 2183260 | 6/1987 | United Kingdom | 57/80 |

*Primary Examiner*—Daniel P. Stodola
*Assistant Examiner*—Michael R. Mansen
*Attorney, Agent, or Firm*—Burns, Doane, Swecker & Mathis

[57] ABSTRACT

A yarn piecing method for a yarn spinning machine including a yarn processing portion comprising a drafting unit, a yarn forming unit, and a yarn winding unit and a yarn piecing unit for piecing an end of a yarn spun from the yarn forming unit with an end of a yarn withdrawn from a yarn package, the method including the steps of guiding yarns to be pieced to each other to a yarn sensor before a yarn piecing operation is carried out, detecting whether any yarn defect exists on one or more of the yarns to be pieced, and determining to carry out the yarn piecing operation when no yarn defect is detected and not to carry it out when a yarn defect is detected.

9 Claims, 5 Drawing Sheets

YARN PIECING METHOD FOR YARN SPINNING MACHINE

BACKGROUND OF THE INVENTION

1. Field of the Invention

The present invention relates to a yarn piecing method in a yarn spinning machine provided with a yarn piecing means and in which a spun yarn spun by and delivered from a yarn forming means and another yarn withdrawn from a yarn package on which the spun yarn is wound are pieced to each other.

2. Description of the Related Art

Generally speaking, a yarn spinning machine such as a fasciated spun yarn spinning machine includes a drafting means, a yarn forming means, a yarn taking-up means, a yarn winding means, and the like. When staple fiber bundles are supplied, a spun yarn such as a fasciated spun yarn is spun in the yarn forming means and wound on a yarn package by the yarn winding means.

When a yarn breaks in the yarn producing process, a yarn piecing operation is usually carried out. Namely, the yarn piecing operation includes the steps of, first, stopping a yarn winding means once; sucking a spun yarn delivered from a yarn forming means (referred to as a first yarn hereafter) by a first yarn sucking means provided on a yarn piecing apparatus; withdrawing a yarn from a yarn package (referred to as a second yarn hereafter) by a second yarn sucking means; and piecing the first and second yarn to each other by carrying the two yarns to a yarn piecing means such as a yarn splicer or a yarn knotter.

In this conventional yarn piecing method, a yarn spun by and delivered from a yarn forming means during a yarn piecing operation is sucked and stored in a yarn storing means provided between a yarn taking up means and the yarn piecing means. Then, when the yarn piecing operation is completed, the non-rotated yarn package is restarted to rotate in such a way that the rotational speed thereof is rapidly increased with a predetermined acceleration to take out the yarn stored in the yarn storing means. Thereafter, the rotational speed of the yarn package is changed to a predetermined yarn winding speed to wind up a spun yarn delivered from the yarn forming means.

When the yarn piecing operation is completed, a condition of whether the spun yarn thus pieced to each other runs normally or not is detected by the yarn sensor.

When the yarn does not run normally, the sensor outputs an alarm signal to stop an operation of the drafting means and thereby to stop the spinning operation in the yarn forming means. Simultaneously, the yarn winding operation in the yarn winding means is stopped by the alarm signal and the yarn piecing means is moved to a spindle to which the yarn piecing operation is required.

In the yarn piecing method as explained above, in which the condition of whether the yarn piecing operation is successful or not is discriminated after the yarn piecing operation is finished, when a yarn is not delivered from the yarn forming means due to, for example, fibers being clogged in a nozzle provided in the yarn forming means, a problem arises of rollers and apron belts provided in the drafting means breaking because a staple fiber bundle supplied from the drafting means is not sucked into the yarn forming means for the 10 to 15 seconds of the yarn piecing operation, but is wound up on the drafting rollers provided in the drafting means.

On the other hand, once the yarn piecing operation is not successful, even if the failure of the yarn piecing operation is caused by the yarn piecing means, there is a possibility of the fibers clogging the nozzle in the yarn forming means.

Therefore, the following procedure is taken in this situation without repeating the yarn piecing operation; The operation mode of the yarn piecing operation is first changed to an operator call mode thereby an operator checks for defects of the yarn or malfunctions of the yarn forming means or yarn piecing means, then the operation mode is changed to a yarn piecing mode to restart the yarn piecing operation.

Accordingly, another problem arises in that the amount of operational work for the operator is increased.

Further, in a plied spun yarn spinning machine, in which two spun yarns spun from separate yarn forming means arranged adjacently and in parallel to each other are plied and wound simultaneously on a yarn package, as shown in Japanese Examined Patent Publication No. 63-42012, when a yarn piecing operation is needed, it is necessary that the two spun yarns each be picked up by a sucking means from the yarn forming means and the yarn package respectively and be carried to the yarn piecing means.

In this system, when only one spun yarn is picked up from any one of the yarn forming means and the yarn package by the yarn picking up means, one yarn picked up from any one of the yarn forming means and the yarn package is pieced with two yarns picked up from the rest or one yarn picked up from any one of the yarn forming means and the yarn package is pieced with one yarn picked up from the rest.

This causes a problem in that a yarn having abnormal knotted portions is wound on a yarn package.

SUMMARY OF THE INVENTION

Therefore, a first object of the present invention is to prevent breakage of the drafting rollers or the apron belts provided in the drafting means and to improve a rate of success in the yarn piecing operation.

A second object of the present invention is to prevent the defective yarn knotted portion from being wound on the yarn package.

To attain the objects of the present invention as explained above, according to a first aspect of the invention, there is provided a yarn piecing method for a yarn spinning machine including a yarn processing portion comprising a drafting means, a yarn forming means, and a yarn winding means and a yarn piecing means for piecing an end of a yarn spun from the yarn forming means with an end of a yarn withdrawn from a yarn package, the yarn piecing method comprising the steps of;

guiding yarns to be pieced to each other to a yarn sensor before a yarn piecing operation is carried out;

detecting whether any yarn defect exists on one or more of the yarns to be pieced; and determining to carry out the yarn piecing operation when no yarn defect is detected and not to carry it out when a yarn defect is detected.

According to a second aspect of the present invention, the yarn spinning machine is provided with a plurality of yarn forming means, at least two yarns spun from separate yarn forming means are simultaneously plied to each other to be wound on a yarn package to form a plied yarn, and the yarn piecing method comprises the steps of plying a plurality of the yarns spun from the forming means with each other to form a plied yarn; guiding the plied yarn to a yarn sensor provided on each one of the yarn processing portions; and determining whether any unusually thick portions exist in the plied yarn.

According to a third aspect of the present invention, a second yarn sensor is provided on a yarn piecing means to detect whether a yarn defect exists or not by leading the yarn to the sensor, whereby the yarn piecing operation further includes the steps of withdrawing a spun yarn from the yarn package guiding the yarn withdrawn from the yarn package to the yarn sensor and determining whether at least a yarn defect exists on the yarn or not.

According to a fourth aspect of the present invention, the yarn piecing method further includes the step of repeating the yarn piecing operation when the sensor detects no yarn defect exists on the spun yarn delivered from the yarn forming means but a failure of the yarn piecing operation is detected by a suitable detector which can detect the failure and provided in a vicinity of the yarn piecing device separated from the sensor.

According to a fifth aspect of the present invention, the yarn piecing method further includes the step of immediately stopping supply of a fiber bundle to the yarn forming means when the sensor detects a yarn defect exists on a spun yarn delivered from the yarn forming means.

According to a sixth aspect of the present invention, the yarn piecing method further includes the steps of repeating the yarn piecing operation when the sensor detects no yarn defect exists on the spun yarn delivered from the yarn forming means but detects a failure of the yarn piecing operation, while stopping to supply a fiber bundle to the yarn forming means immediately when the sensor detects an abnormal condition on a spun yarn delivered from the yarn forming means.

DESCRIPTION OF THE PREFERRED EMBODIMENTS

Figure 1:
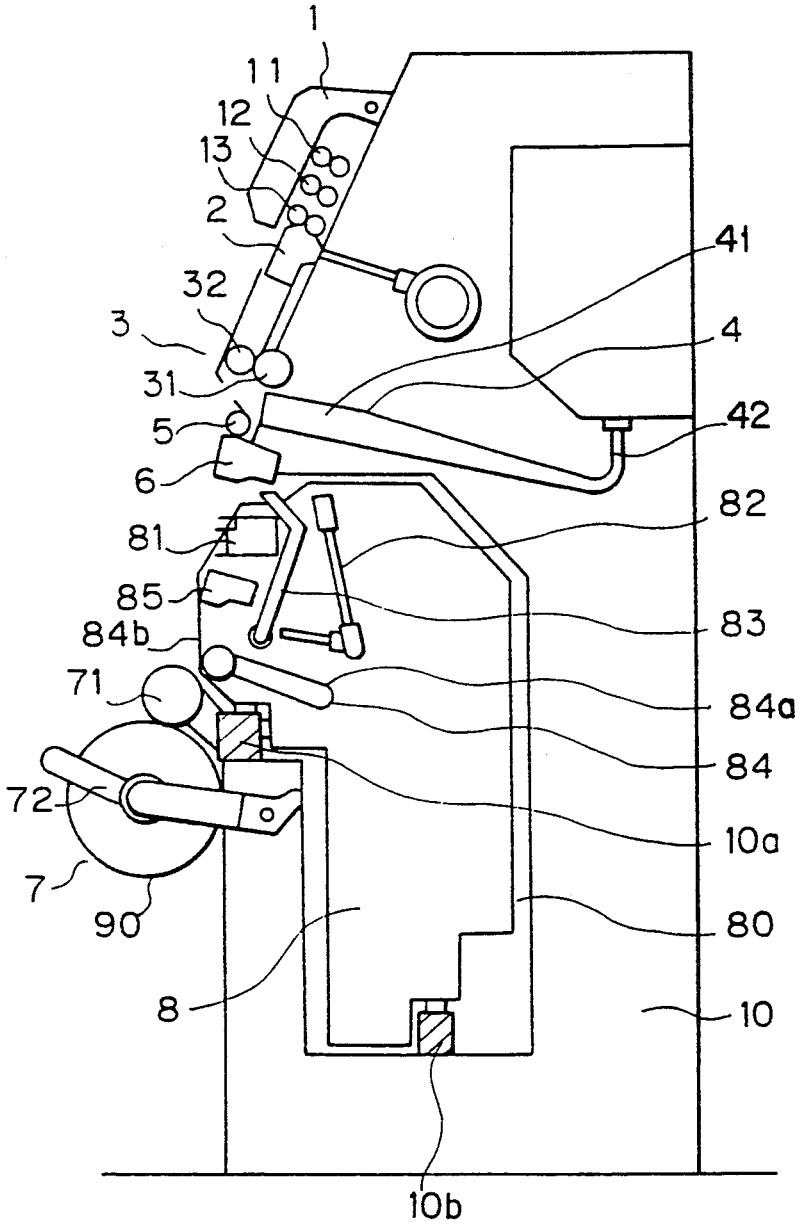
FIG. 1 is a cross-sectional view of one embodiment of a yarn piecing apparatus for carrying out a yarn piecing operation of the present invention.

A construction of a spinning machine which is suitable for the yarn piecing method of the present invention will now be described with reference to the drawings.

This embodiment relates to a spun yarn spinning machine with a yarn piecing means.

A drafting means 1 including back rollers 11, middle rollers 12, and front rollers 13 is provided on a machine frame 10.

Note that in the drafting means 1, the back rollers 11 are provided with a stopping mechanism for stopping rotation by separating rollers from a driving shaft (not shown).

A yarn forming means 2 is also provided in the machine frame 10 adjacent to the front rollers 13 of the drafting means 1. A staple fiber bundle delivered from the front rollers 13 is sucked into it and formed into a fasciated spun yarn, for example, by applying a whirling force generated by compressed air onto the staple fiber bundle.

A yarn forming means as shown in Japanese Unexamined Patent Publication No. 63-243335 can be used in the present invention.

A yarn taking-up means 3 is also provided. It is arranged underneath the yarn forming means 2 with a predetermined space therebetween. The yarn taking-up means 3 includes a driving roller 31 and a nip roller 32 having a small width. One end of the rotating shaft thereof is supported by a suitable bearing. The means 3 can take up a spun yarn delivered from the yarn forming means 2 at a predetermined speed.

A yarn storing means 4 is provided and arranged underneath and adjacent to the yarn take-up means 3.

The yarn storing means 4 includes a yarn sucking tube 41 having a substantially flat rectangular cross-sectional configuration. One end is opened to a position through which the spun yarn passes while the opposite end is connected to a pneumatic duct 42 with a negative pressure source (not shown).

A tensioning means 5 for applying a suitable tension to a spun yarn is provided underneath the yarn storing means 4 and includes a yarn tensor and a cutter which can be of known construction.

A sensor yarn 6 is provided integrally mounted on a portion underneath of the tensioning means 5 to detect information whether a yarn exists or not and the thickness of a spun yarn.

A yarn winding means 7 is provided underneath the yarn sensor 6 and includes a driving roller 71 connected to a line shaft through a clutch mechanism and provided with a groove on a peripheral surface thereof for traversing a yarn to be wound on a package and a cradle 72, rotatably supporting a yarn bobbin and having a pressuring means whereby the yarn bobbin is attached to a surface of the driving roller 71 with a predetermined surface pressure to wind the spun yarn delivered from the yarn taking-up means 3 on the yarn bobbin.

Usually, a yarn producing unit includes a drafting means 1, a yarn forming means 2, a yarn taking-up means 3, a yarn storing means 4, a yarn tensioning means 5, a sensor 6, and a yarn winding means 7. A plurality of the yarn producing units are arranged in a longitudinal direction of a spun yarn spinning machine frame 10 with a predetermined space therebetween.

On the other hand, a yarn piecing apparatus 8, i.e., a traveling unit, is provided in the machine frame 10 and travels along rails **10*a* and 10*b* arranged in a longitudinal direction of the machine frame 10** to piece yarns on a yarn producing unit in which yarn breakage occurs.

Note that when yarn breakage occurs, a first yarn delivered from the yarn forming means 2 and a second yarn withdrawn from a yarn package 90 on which a spun yarn is wound are pieced to each other.

A detailed description of the yarn piecing apparatus 8 will be explained hereunder with reference to FIGS. 2 and 3.

Figure 2:
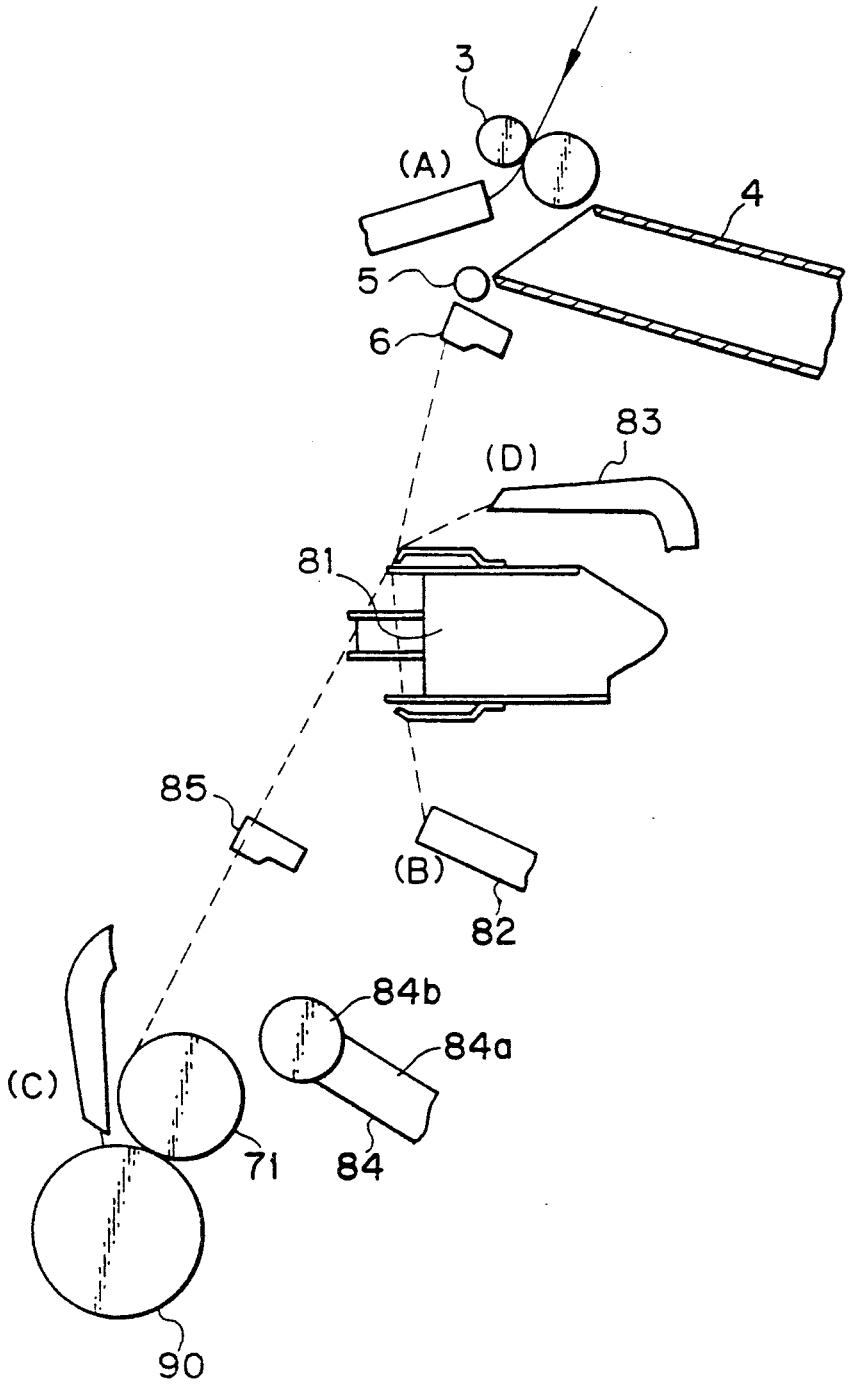
FIG. 2 is a schematic cross-sectional view showing a yarn piecing operation means.

In FIG. 2, a splicer 81 is provided on the traveling unit 80 and arranged between the tensioning means 5 and yarn winding means 7 as explained above to piece a first yarn delivered from the yarn forming means 2 and a second yarn withdrawn from a yarn package on which a spun yarn is wound.

The splicer 81 is fixedly mounted on a traveling unit 80 by a bracket 93 so as to take its position between the yarn sensor 6 and the yarn winding means 7.

The splicer 81 pieces an end portion of the first yarn delivered from the yarn forming means 2 with an end portion of the second yarn withdrawn from the yarn package 90.

The splicer 81 includes a yarn guiding plate for guiding a yarn to a predetermined place at which the yarn piecing operation will be carried out, yarn gripping needles for gripping the first and the second yarn, and a yarn piecing means.

A first-yarn sucking means 82 is provided pivotally mounted on the traveling unit 80, one end thereof being connected to a negative pressure source (not shown), for example, a blower.

The other end thereof is opened to the air to form a sucking aperture.

The sucking aperture can move between a yarn sucking portion (A) beneath the yarn taking-up means 3 and a waiting portion (B) beneath the yarn splicer 81, so the yarn delivered from the yarn taking-up means 3 is sucked into the sucking means 82 as a first yarn and thus the first yarn is carried to a yarn piecing portion of the splicer 81.

A second yarn sucking means 83 is provided pivotally mounted on the unit 80, one end thereof being connected to a negative pressure source (not shown), for example, a blower.

The other end thereof is formed as a yarn sucking aperture having the same width as that of the yarn package.

The sucking aperture thereof can move between a yarn sucking portion (C) adjacent to a yarn package 90 provided on a cradle 72 and a waiting portion (D) beneath the yarn splicer 81 to transfer the yarn withdrawn from the yarn package 90 by a sucking force to a yarn piecing portion of the splicer 81, as the second yarn.

In the present invention, a roller driving means 84 is provided and includes an arm **84*a* pivotally mounted on the unit 80, utilizing a bearing means, a roller 84*b* rotatably mounted on one end of the arm 84*a*, a cylinder for rotating the arm 84*a*** (not shown), and an electric motor such as an induction motor or a pulse motor (not shown) for rotating the roller both forward and reverse.

Therefore, the driving roller 71 of the yarn winding means 7 can be rotated both forward and reverse.

A second yarn sensor 85 is provided on the traveling unit arranged between the yarn winding means 7 and the yarn splicer 81. The second yarn sensor 85 defines a detector that is separate from the yarn sensor 6.

The second yarn sensor 85 detects a yarn existence, a yarn thickness, or the like.

The operation of the yarn drafting means 1, the yarn winding means 7, the yarn piecing means 8, or the like, as explained above, are controlled by a microcomputer or a suitable controlling device (not shown) including an input circuit for a setting operation, a memory circuit, a comparator, a processing circuit, an operation directing circuit, or the like.

When yarn breakage occurs during a yarn forming operation and yarn winding operation in the spun yarn spinning machine as explained above, first the rotation of the back rollers 11 in the drafting means 1 is stopped in response to a signal generated from a controller (not shown), whereby delivery of a spun yarn from the yarn forming means 2 is interrupted. Rotation of the yarn package 90 is stopped due to the driving roller 71 of the yarn winding means 7 being removed from a line shaft by actuating a clutch (not shown).

Then, when the yarn piecing apparatus 8 is moved to the yarn producing unit on which the yarn breakage occurred, the yarn piecing operation is carried out along the sequential steps shown in FIG. 4 in turn.

First, when the first yarn sucking means 82 is rotated and the sucking aperture thereof is moved to the position (A) beneath the yarn taking-up means 3, the drafting means 1 is restarted to supply a staple fiber bundle to the yarn forming means 2, whereby a fasciated spun yarn is spun out therefrom and delivered from the yarn taking up means 3 at a predetermined speed.

Next, the yarn delivered from a point formed between the driving roller 31 and the nip roller 32 is sucked by the yarn sucking aperture as a first yarn. (shown in FIG. 4-1).

Then, the first yarn sucking means 82 is swung to return the sucking aperture to the waiting position (B), whereby the first yarn is transferred to the yarn piecing portion of the splicer 81 (shown in FIG. 4-2).

In accordance with the operation as explained above, when the first yarn is introduced into the yarn sensor 6, the yarn existence, the yarn thickness, or the like are detected by the yarn sensor 6.

Simultaneously with the operational movement as mentioned above, the second yarn sucking means 83 is rotated and the aperture thereof is moved to a position (C) for sucking the second yarn above the yarn package 90 while the roller driving means 84 is actuated, whereby the arm **84*a* is rotated enabling the roller 84*b* to be contacted to the drive roller 71 of the yarn winding means 7**.

Therefore, the yarn package 90 is rotated in an opposite direction to the yarn winding direction with the driving roller 71.

After that, an end of the yarn contacting a peripheral surface of the yarn package 90 is sucked into the yarn sucking aperture (shown in FIG. 4-1).

When the yarn is withdrawn from the yarn package 90 as a second yarn, the second yarn sucking means 83 is rotated to move back the yarn sucking aperture to a waiting position (D), whereby the second yarn is transferred to the yarn piecing means of the splicer 81 (shown in FIG. 4-2).

Figure 3:
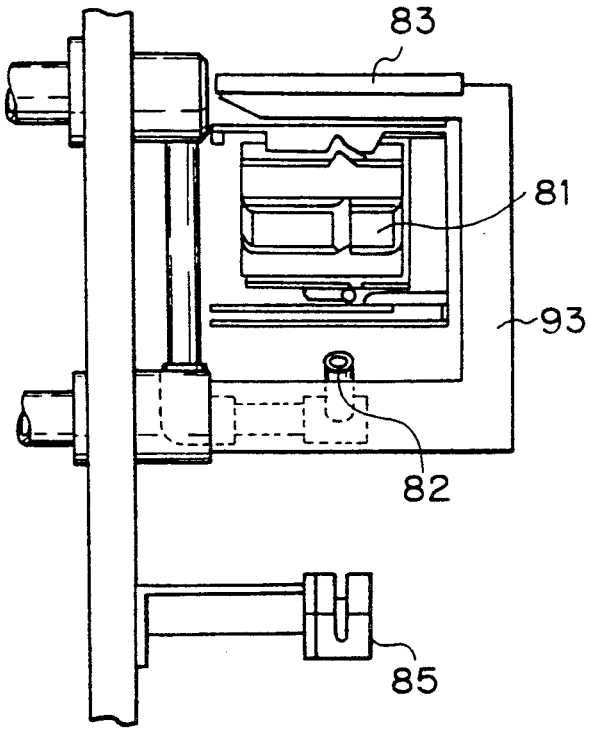
FIG. 3 is a schematic front of the yarn piecing apparatus as shown in FIG. 2.
Figure 4A:
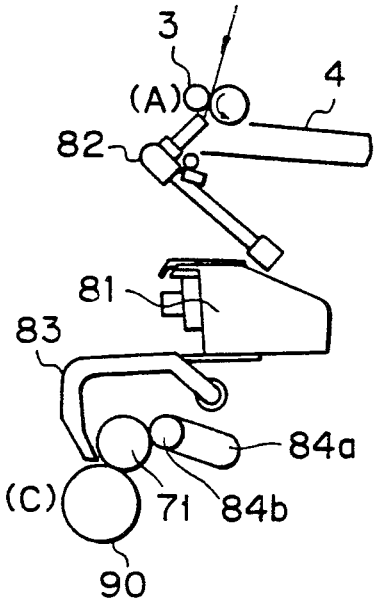
FIG. 4 is a schematic view illustrating a yarn piecing operation of the present invention.
Figure 4B:
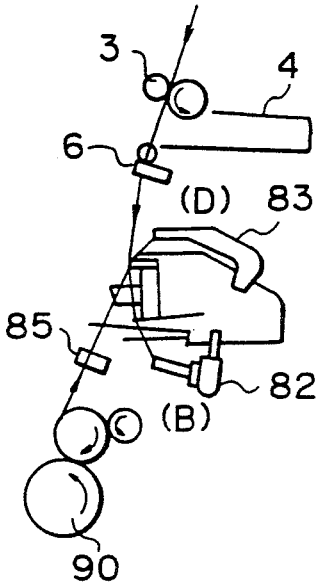
Figure 4C:
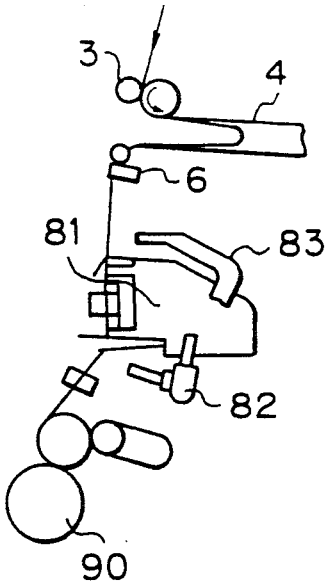
Figure 4D:
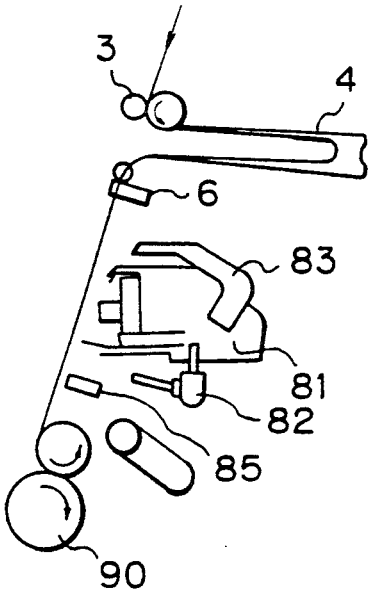

When a detecting operation in which a yarn existence is detected is carried out by the yarn sensor 6 as explained above, and a signal indicating a yarn exists to a controller (not shown), the controller determines that a spun yarn is normally spun from the yarn forming means 2 whereby the splicer is actuated to piece the first and the second yarns to each other (shown in FIG. 4-3).

When a signal informs the controller no yarn exists, the controller determines that a spun yarn is not spun from the yarn forming means 2 due to an abnormal condition in which, for example, the fibers are clogged in the nozzle or the like, therefore a spun yarn could not be sucked by the first yarn sucking means.

Therefore, a rotation of the back-roller 11 of the drafting means 1 is immediately stopped, whereby a supply of a fiber bundle, i.e., sliver, to the drafting means is stopped.

Simultaneously, a yarn cutter provided on the splicer 81 or the like is actuated to cut a yarn between the yarn package 90 and the second yarn sucking means 83.

On the other hand, when a thickness of at least a part of a yarn is different from a predetermined value, the controller determines that a thickness of the fiber bundle, i.e., the sliver, is different from a predetermined value or variation in a yarn thickness exists, then immediately stops rotation of the back-roller 11 of the drafting means 1 and simultaneously activates a yarn cutter provided on the splicer 81 to cut a yarn between the yarn package 90 and the second yarn sucking means 83 so as to prevent the normal yarn wound on the yarn package from being pieced with the abnormal spun yarn having a thickness being different from a predetermined value.

In the second yarn withdrawing operation, when a predetermined amount of the second yarn is withdrawn from a package 90, the roller driving means 84 is reversely rotated to rotate the yarn package 90 in an opposite direction.

Therefore, when the yarn piecing operation by the splicer 81 is completed, the roller driving means 84 is actuated to make an arm 84*a* swing, whereby the yarn package 90 is removed from a surface of the roller 84*b*.

Simultaneously, a clutch means of the yarn winding means 7 is actuated, whereby a driving roller 71 is connected to a line shaft causing the start of a yarn winding operation (shown in FIG. 4-4).

Figure 5:
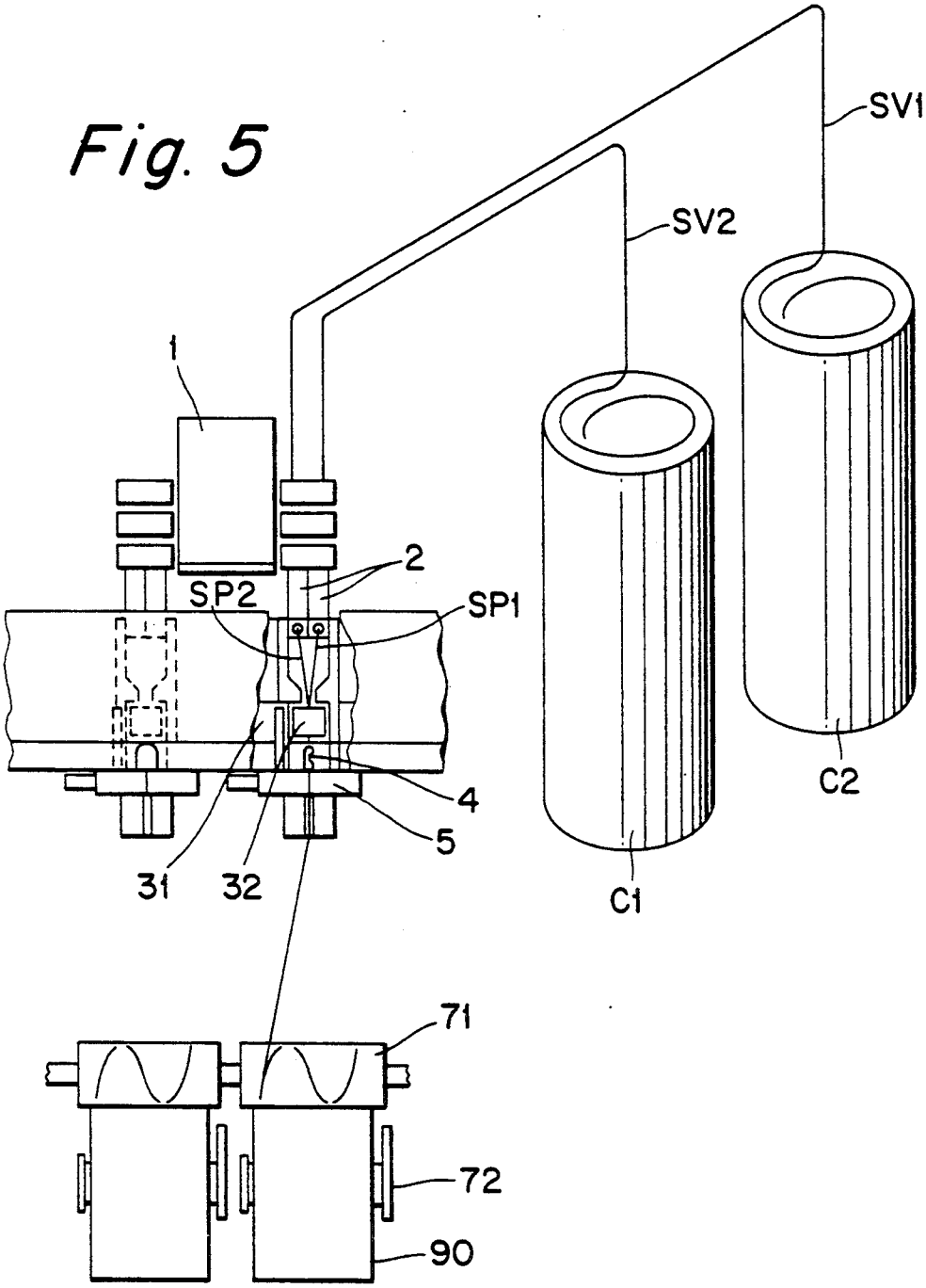
FIG. 5 is a a schematic illustration of one possible plied yarn making process according to the present invention.

After the yarn piecing operation is completed by the splicer 81 as explained above, when a signal indicating that no yarn exists is output from the yarn sensor 6 to the controller (not shown), the controller determines that the yarn splicer 81 failed to piece the yarns in the yarn piecing operation and makes the yarn splicer repeat the yarn piecing operation. Note that the yarn piecing operation of the present invention can be applied to another spun yarn spinning method in which a plurality of spun yarns spun from separate yarn forming means, for example, two or three, are plied and wound simultaneously on a yarn package as a plied yarn. For example, as seen in FIG. 5, two slivers SV1 and SV2 are supplied from respective sliver cans C1 and C2 to a drafting means 1 and are guided to each yarn forming means 2 to be formed into spun yarn SP1 and SP2. Both spun yarns SP1 and SP2 can then be simultaneously introduced into a nip point formed between a drive roller 31 and a nip roller 32 and through a yarn storing means 4 and a yarn tensioning means 5 to form a plied yarn ply which is wound to form a yarn package 71.

In this case, the plied yarn formed by plying a plurality of the spun yarns thus spun is guided to the yarn sensor and the sensor determines whether the plied yarn exists or not or whether an abnormal yarn thickness in the plied yarn exists or not.

On the other hand, a yarn withdrawn from a yarn package is guided to the second yarn sensor 85, which sensor 85 determines whether a yarn exists or not or whether an abnormal yarn thickness in the yarn exists or not.

When the sensor detects that a thickness of a yarn is thinner than a predetermined value, the controller determines that a spun yarn or all of spun yarns thus withdrawn from a yarn package are not sucked by the second yarn sucking means 83.

Then, a rotation of the back roller 11 in the drafting means 1 is immediately stopped and simultaneously the cutter provided on the splicer 81 or the like is actuated to cut a yarn existing between the yarn package 90 and the second yarn sucking means 83.

Therefore, even when a nozzle provided in the yarn forming means 1 is clogged by fibers, the rollers are prevented from being broken due to the fibers being wrapped around a surface of the rollers. Further, one can prevent only one spun yarn being pieced plied yarn.

Note that the plied spun yarn spinning machine as explained above can be applied to a method in which a plied yarn comprising more than two spun yarns is spun.

In accordance with the first aspect of the invention, the problem of a yarn having an abnormal thickness being mixed in a yarn package can be prevented and the rollers or apron belts can be prevented from being broken due to fibers wrapped around a surface of the driving rollers in the drafting means.

In accordance with the second and third aspects of the present invention, different number of yarns, for example, only one spun yarn in the first yarns or the second yarns and two spun yarns in the second yarns or the first yarns, are prevented from being pieced to each other as a plied yarn. Thus, defective yarn knotted portions in a yarn package can be avoided.

In accordance with the fourth aspect of the present invention, a detector which detects whether the yarn piecing operation succeeds or not, is provided separately from the sensor which detects whether the yarn defects exists or not and thereby the yarn piecing operation can be repeatedly carried out immediately when the yarn piecing operation by the yarn piecing means fails, whereby a rate of success in the yarn piecing operation can be improved and an amount of operational work for an operator can be reduced.

In accordance with the fifth aspect of the present invention, the rollers or apron belts are prevented from being broken due to fibers being wrapped around a surface of the driving rollers in the drafting means.

We claim:

1. A yarn piecing method useable in a yarn spinning machine that includes a yarn processing portion comprising a drafting means for drafting a yarn, a yarn forming means for forming a yarn delivered from said drafting means and a yarn piecing means for piecing an end of a newly formed yarn spun from the yarn forming means with an end of a previously formed and already wound yarn withdrawn from a yarn package, said yarn piecing method comprising the steps of:

guiding newly formed yarn spun from said yarn forming means that is to be pieced with a previously formed and already wound yarn on a yarn package toward said yarn piecing means past a first yarn sensor provided between said yarn forming means and said yarn piecing means;

withdrawing a previously formed and already wound yarn from said yarn package;

guiding said previously formed yarn toward said yarn piecing means;

detecting through use of said first yarn sensor whether a yarn defect exists on said newly formed yarn before a piecing operation is carried out;

determining that said yarn piecing operation should be carried out when said first yarn sensor detects no yarn defect on said newly formed yarn and determining that said yarn piecing operation should not be carried out when said first yarn sensor detects a yarn defect on said newly formed yarn; and piecing an end of said newly formed yarn and an end of said previously formed yarn withdrawn from said yarn package through operation of said yarn piecing means when it is determined in said determining step that a yarn piecing operation should be carried out.

2. A yarn piecing method for a yarn spinning machine according to claim 1, wherein a second yarn sensor is provided between said yarn piecing means and a yarn winding means and said yarn piecing method further includes the steps of guiding said previously formed and already wound yarn from said yarn package to said yarn piecing means through said second yarn sensor, detecting whether a yarn defect exists on said previously formed yarn withdrawn from said yarn package through operation of said second yarn sensor, and determining that said yarn piecing operation should be carried out when said second yarn sensor detects no yarn defect and determining that said yarn piecing operation should not be carried out when said second yarn sensor detects a defect.

3. A yarn piecing method for a yarn spinning machine according to claim 2, wherein said yarn piecing method further includes the steps of repeating said yarn piecing operation after said yarn piecing operation has been carried out by once again withdrawing said previously formed yarn wound on said yarn package and guiding the withdrawn yarn to said yarn piecing means to which newly formed yarn delivered from said yarn forming means has already been guided and piecing an end of the previously formed yarn withdrawn from the yarn package with an end of the yarn from said yarn forming means through operation of said yarn piecing means, said step of repeating said yarn piecing operation being performed when said first yarn sensor detects that no yarn defect exists on said newly formed yarn delivered from said yarn forming means but when a failure of said yarn piecing operation is detected by said second yarn sensor due to the absence of yarn between said yarn piecing means and said yarn package.

4. A yarn piecing method for a yarn spinning machine according to claim 2, wherein said yarn piecing method further includes the steps of repeating said yarn piecing operation after said yarn piecing operation has been carried out by once again withdrawing said previously formed yarn wound on said yarn package and guiding the withdrawn yarn to said yarn piecing means to which newly formed yarn delivered from said yarn forming means has already been guided and piecing an end of the previously formed yarn withdrawn from the yarn package with an end of the yarn from said yarn forming means through operation of said yarn piecing means, said step of repeating said yarn piecing operation being performed when said first yarn sensor detects that no yarn defect exists on said newly formed yarn delivered from said yarn forming means but when a failure of said yarn piecing operation is detected by said second yarn sensor due to the absence of yarn between said yarn piecing means and said yarn package, and stopping a supply of a fiber bundle to the yarn forming means immediately when the first yarn sensor detects an abnormal condition on a newly formed yarn delivered from said yarn forming means.

5. A yarn piecing method for a yarn spinning machine according to claim 1, wherein said yarn piecing method further includes the step of immediately stopping the supply of a fiber bundle to said yarn forming means when said first yarn sensor detects a yarn defect exists on said newly formed yarn delivered from said yarn forming means.

6. A yarn piecing method for a yarn spinning machine that includes a yarn processing portion comprising a drafting means for drafting yarn, a plurality of yarn forming means for forming yarn, a yarn winding means for winding yarn and a yarn piecing means for piecing an end of a newly formed yarn spun from said yarn forming means with an end of a previously formed and already wound yarn withdrawn from a yarn package, wherein a plurality of yarns spun from each one of the plurality of yarn forming means are arranged adjacent to each other and are simultaneously plied with each other to be wound on a yarn package to thereby form a plied yarn, said yarn piecing method comprising the steps of:

guiding each one of a plurality of said yarns to be plied with each other and to be pieced with a previously formed and already plied yarn wound on a yarn package from respective yarn forming means toward said yarn piecing means past a first yarn sensor provided between said plurality of yarn forming means and said yarn piecing means;

plying a plurality of said spun yarns with each other to form a newly formed plied yarn before said plied yarn passes through said yarn sensor;

withdrawing a deviously formed plied yarn already wound on a yarn package from said yarn package;

guiding said previously formed plied yarn to said yarn piecing means;

detecting through operation of said first yarn sensor whether an undesirably thick portion exists in said newly formed plied yarn before a piecing operation is carried out;

determining that said yarn piecing operation should be carried out when said first yarn sensor detects no undesirably thick portion on said newly formed plied yarn and determining that said yarn piecing operation should not be carried out when said first yarn sensor detects an undesirably thick portion on said newly formed plied yarn; and piecing an end of said newly formed plied yarn and an end of said previously formed plied yarn through operation of said yarn piecing means when it is determined in said determining step that a yarn piecing operation should be carried out.

7. A yarn piecing method for a yarn spinning machine according to claim 6, wherein a second yarn sensor is provided between said yarn piecing means and said yarn winding means, said yarn piecing method further includes the steps of guiding said previously formed and already wound plied yarn from said yarn package yarn toward said yarn piecing means through said second yarn sensor, detecting through operation of the second yarn sensor whether a yarn defect exists on said previously formed plied yarn withdrawn from said yarn package, and determining that said yarn piecing operation should be carried out when no yarn defect is detected on said previously formed plied yarn withdrawn from said yarn package and determining that said yarn piecing operation should not be carried out when said yarn defect is detected on said previously formed plied yarn withdrawn from said yarn package.

8. A yarn piecing method for a yarn spinning machine according to claim 7, wherein said yarn piecing method further includes the steps of repeating said yarn piecing operation after said yarn piecing operation has been carried out by once again withdrawing said previously formed and already wound plied yarn from said yarn package and guiding the withdrawn yarn to said yarn piecing means to which newly formed plied yarn delivered from said yarn forming means has already been guided and piecing an end of the previously formed plied yarn withdrawn from the yarn package with an end of the newly formed plied yarn from said yarn forming means through operation of said yarn piecing means, said step of repeating said yarn piecing operation being performed when said first yarn sensor detects that no yarn defect exists on said newly formed plied yarn delivered from said yarn forming means but when a failure of said yarn piecing operation is detected by said second yarn sensor due to the absence of yarn between said yarn piecing means and said yarn package.

9. A yarn piecing method for a yarn spinning machine according to claim 7, wherein said yarn piecing method further includes the steps of repeating said yarn piecing operation after said yarn piecing operation has been carried out by once again withdrawing said previously formed and already wound plied yarn from said yarn package and guiding the withdrawn yarn to said yarn piecing means to which newly formed plied yarn delivered from said yarn forming means has already been guided and piecing an end of the prevously formed plied yarn withdrawn from the yarn package with an end of the newly formed plied yarn from said yarn forming means through operation of said yarn piecing means, said step of repeating said yarn piecing operation being performed when said first yarn sensor detects that no yarn defect exists on said newly formed plied yarn delivered from said yarn forming means but when a failure of said yarn piecing operation is detected by said second yarn sensor due to the absence of yarn between said yarn piecing means and said yarn package, and stopping a supply of a fiber bundle to the yarn forming means immediately when the first yarn sensor detects an abnormal condition on a spun yarn delivered from said yarn forming means.

* * * * *